US009085119B2

(12) United States Patent
Haddock

(10) Patent No.: US 9,085,119 B2
(45) Date of Patent: Jul. 21, 2015

(54) PARTITIONED GAME CARD HOLDER USING MONOCOQUE CONSTRUCTION

(71) Applicant: Richard M. Haddock, Emerald Hills, CA (US)

(72) Inventor: Richard M. Haddock, Emerald Hills, CA (US)

( * ) Notice: Subject to any disclaimer, the term of this patent is extended or adjusted under 35 U.S.C. 154(b) by 0 days.

(21) Appl. No.: 14/165,568

(22) Filed: Jan. 27, 2014

(65) Prior Publication Data

US 2014/0235418 A1 Aug. 21, 2014

Related U.S. Application Data

(60) Provisional application No. 61/757,208, filed on Jan. 27, 2013.

(51) Int. Cl.
*A63F 1/10* (2006.01)
*B31D 5/04* (2006.01)

(52) U.S. Cl.
CPC .... *B31D 5/04* (2013.01); *A63F 1/10* (2013.01)

(58) Field of Classification Search
USPC ..... 493/395, 374, 390–392; 40/124.06; 273/148 R, 148 A
IPC ..... A63F 1/10
See application file for complete search history.

(56) References Cited

U.S. PATENT DOCUMENTS

| | | | | |
|---|---|---|---|---|
| 1,748,419 | A * | 2/1930 | Hurley | 40/124 |
| 1,824,918 | A * | 9/1931 | Nelson et al. | 40/5 |
| 2,665,916 | A * | 1/1954 | Lakatos | 273/150 |
| 3,029,537 | A * | 4/1962 | Philip et al. | 40/653 |
| 5,617,292 | A * | 4/1997 | Steiner | 361/706 |
| 5,911,419 | A * | 6/1999 | Delaney et al. | 273/292 |
| 6,543,729 | B1 * | 4/2003 | Ylonen | 248/48.1 |
| 6,984,130 | B2 * | 1/2006 | Richter et al. | 439/66 |

* cited by examiner

*Primary Examiner* — Christopher Harmon

(57) ABSTRACT

The invention provides an improved game playing card holder made from monocoque construction providing a plurality of card compartments using raised fins through linear slits in the frame. The fins protrude vertically from the card holding surface provides a separation boundary between card types as required by individual game requirements. The rear support of the card compartment is a common wall providing a uniform presentation of the decks to the dealer. The supporting top surface is raised at an approximate 20 degree angle from the base, with the front card edge of each deck protruding beyond the front support of the card base, allowing ease of access to the cards to create improved card handling and dealing characteristics of the holder. The metallic structure allows application of electrostatic powder coat finishes providing long durability with enhanced appearance.

1 Claim, 3 Drawing Sheets

PARTITIONED GAME CARD HOLDER USING MONOCOQUE CONSTRUCTION

BACKGROUND OF THE INVENTION

Game card holders are well known in the art and come in a multitude of designs and materials. Typical game card holders are formed from plastic, wood, or cardboard. Drawbacks from these types of card holding products include ease of breakage or damage in use, high cost of injection molding dies for plastic versions, need for multiple pieces and assembly for wood and cardboard, potential damage from spilled liquids or drops from heights, bulk of materials, and excessive product size and weight required to provide mechanical strength. The subject of this invention teaches a method and design to eliminate the traditional game card holder drawbacks and provides improvement to the state of the art.

SUMMARY

An ultra-weight and high strength multi-partitioned game card holder is formed from a single sheet of material using stressed skin monocoque construction methods with internal locking mechanisms in the preferred embodiment. The formed game card holder has a series of card partitions separated by thin curved fins which also function as the locking fins to secure the construction. An integrated card back support and sloped elevated base design optimize the design for ease of use for games requiring frequent handling of cards. High stiction polymer low profile feet mounted to the base of the unit provide a solid platform for operational use on a variety of playing surfaces.

DESCRIPTION

Figure 1:
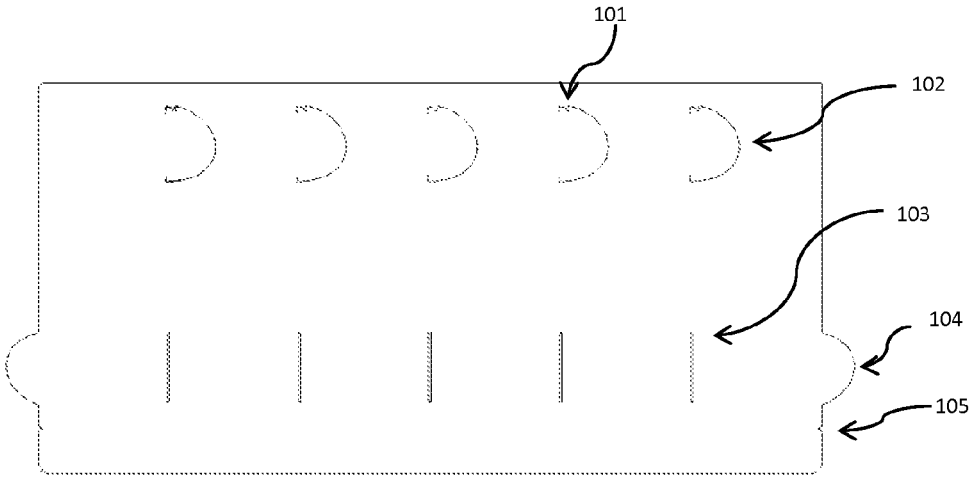
FIG. 1: Flat pattern prior to bending showing typical layout for a card holder

The invention is implemented by constructing a single cut panel (FIG. 1) of the appropriate material (grade 5052 alloy aluminum in 22 gauge thickness is the preferred material), providing high tensile strength, excellent bending and forming properties, good machinability, and low material cost. FIG. 1 illustrates the following features: 101: Locking notch on separation Fin; 102: Partition Separating Fin; 103: Fin Slot; 104: End Fin; 105: Rear Card Support Bending Index Notch.

Figure 4:
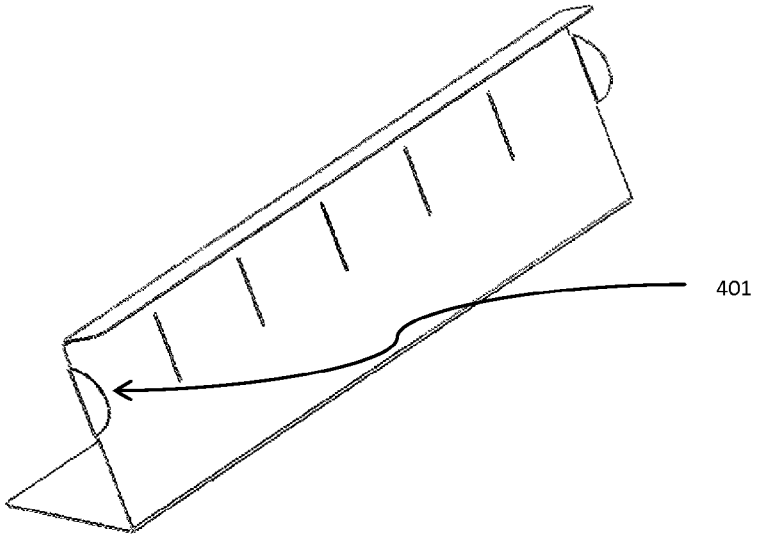
FIG. 4: In Process Bending Detail

The preferred method is to use water jet cut cutting to create the initial flat panel part used to form the product which reduces material waste cost, labor costs, and eliminates the need for costly tooling for low volume production. Bending the flat panel in 3 stages (FIG. 4) starts the formation of the stressed monocoque frame. Feature 401 of FIG. 4 shows initial bends for rear card support and end fins, front riser bent into position prior to base plate bend.

Figure 3:
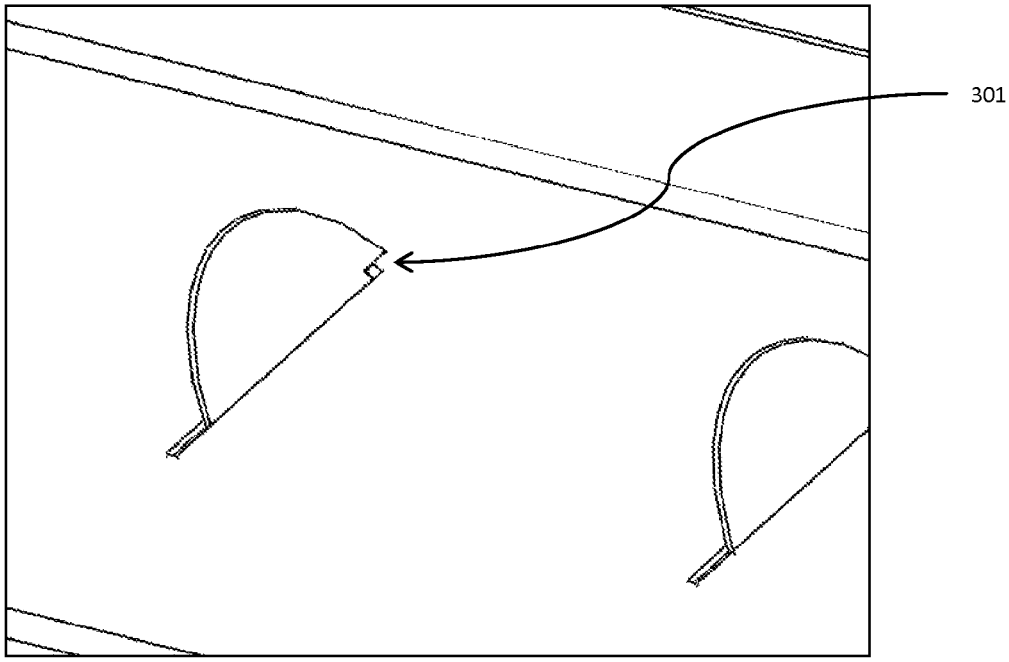
FIG. 3: Locking Fin Detail
Figure 5:
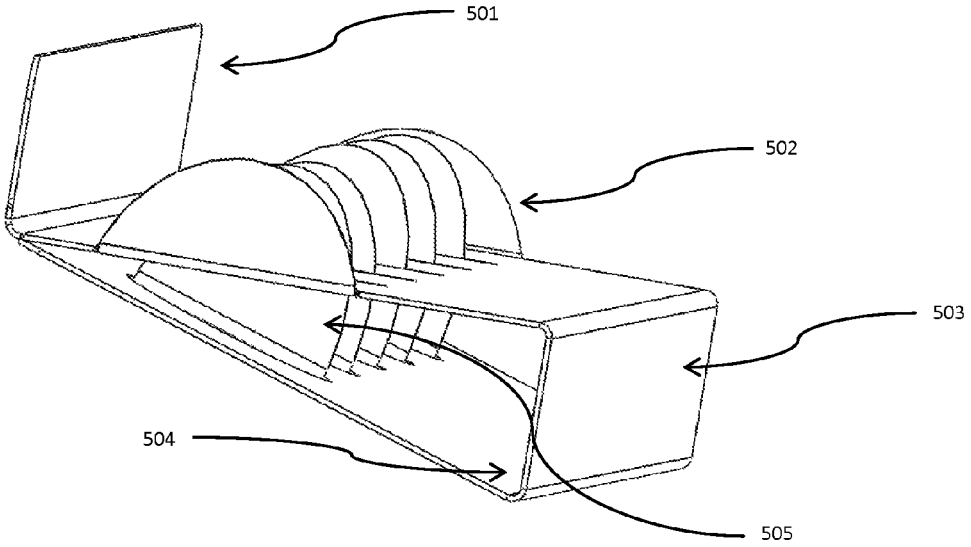
FIG. 5: End view showing construction detail after locking fins are inserted

The thin skin frame structure can be hand formed using traditional sheet metal bending tools in a few seconds and results in an elongated tube type structure open along the long axis. The final construction secures the base surface to the top surface by a series of interlocking notches on the partitioning fins inserted through slots in the upper surface of the card holder (FIG. 3) forming a closed structure (FIG. 5). Feature 301 of FIG. 3 shows a Fin notch locked into the Rear fin slot. FIG. 500 shows the following features: 501: Rear card support formed; 502: End fins bent into position; 503: Front riser formed; 504: 20 degree card holder slope formed by base plate bend and front riser; 505: Five internal fins bent into position through upper slots and locked into place by notches.

Figure 2:
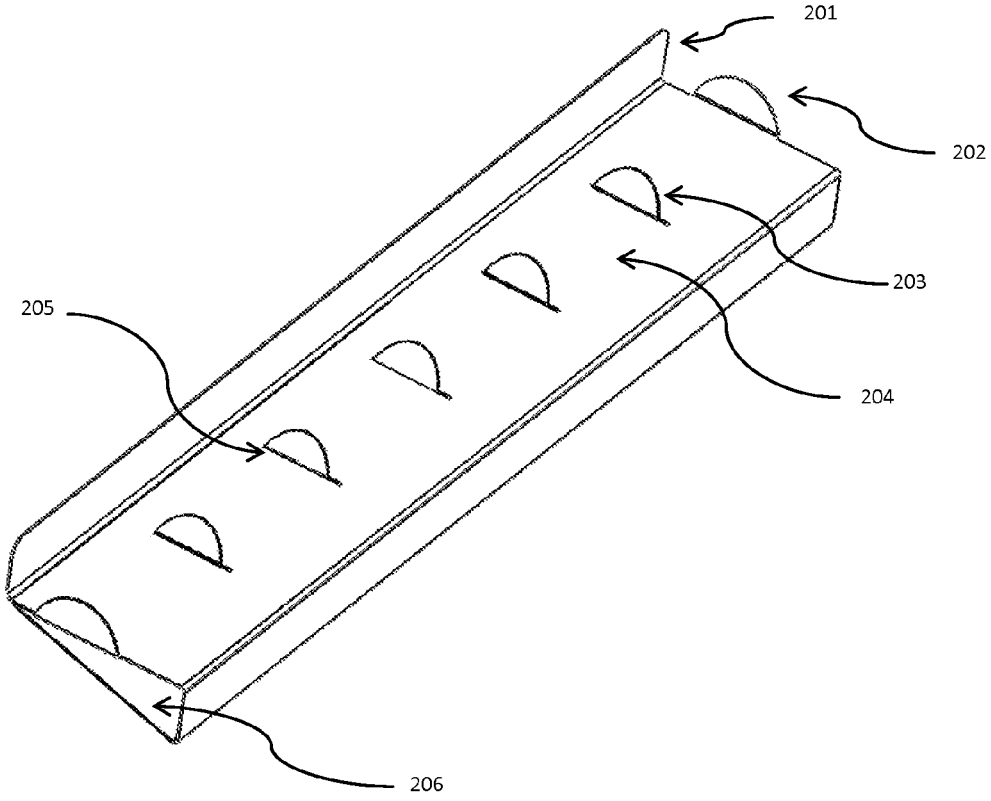
FIG. 2: Finished Card Holder After Bending and Separator Fins in Locked Position

Bending two end half circular fins upward completes the formation of the card holding partitions (FIG. 2). FIG. 2 illustrates the following features: 201: Rear Card Support After Bending; 202: End Fin Separator; 203: Partition Separating Fin; 204: Card partition space; 205: Locking Notch; 206: 20 degree slope formed in base to top angle planes.

Figure 6:
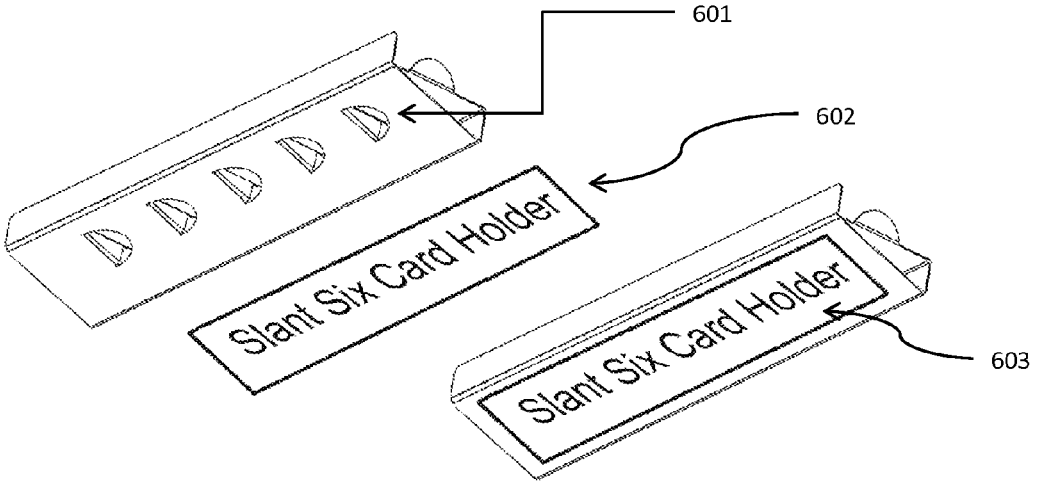
FIG. 6: Bottom view of Baseplate showing Fin Cavities

In the preferred implementation, the raw aluminum surfaces are finished using high temperature baked polymer powder coating for a durable and lasting appearance, enhancing product appeal over traditional card holders. The addition of low durometer silicon self-adhesive feet on the bottom surface is required to generate sufficient stiction to eliminate sliding or motion of the card holder during vigorous gaming conditions. The cavities on the underside formed by the creation of the locking fins structures (FIG. 6) are covered with a self-adhesive printed label to provide a product labeling surface and to provide protection against accidental insertion of fingers into the cut recesses of the product. FIG. 6 shows the following features 601: Cavities in bottom Baseplate formed after Separating Tabs are bent and positioned through upper plate slots and notches locked; 602: Bottom label, polyester self-adhesive preferred; 603: Cavities are covered by product label when finishes.

The typical implementation of the product will provide six partitions for different gaming cards, each separated by a thin (25 thousands of an inch) curved fin, minimizing the overall product length to less than ¼" over the length of the six cards themselves. No other game card holder provides such low physical overhead. The resulting weight of the product is less than four ounces, less than the supported game cards themselves, again minimizing the product impact on the game storage and transport overhead. The game cards are partially supported by the sloped base surface at an approximate 20 degree angle, with the last ½" of card surface protruding outside the holder. This provides and optimum presentation of the card stock to allow fast and secure handling of the cards while dealing or replacing cards in play.

What is claimed is:

1. A playing card holder comprising an elongated sloped monocoque shell with an upper surface for maintaining playing cards distributed and held across the upper surface in separated compartments above a playing surface; the playing card holder formed from a single flat sheet of bendable material by the following process:

a. cutting two or more slots to provide a slotted pattern region and symmetrical fin pattern in the flat sheet material; the fins being curved with a precise height and design to allow bending of the slotted pattern region over the fins; and each comprising a toothed notch on one side at the fin base for providing a locking position;

b. bending the fins 90 degrees with respect to a base surface of the sheet material thereby providing curved holes;

c. bending the sheet material to define a base and upper card support surface so that the slotted pattern region is positioned over the fins;

d. positioning the fins through the corresponding slots and into a locked position using the fin notches wherein the base is retained to the upper card support surface in a sloped position and a long side cut edge of the base material held in contact with the corner of a folded back support of the upper card support surface;

e. applying an electrostatic powder coat finish cured at a high temperature to further lock the surfaces together and provide a protective smooth finish;

f. applying a cover material over the curved holes in the base surface in order to provide a smooth bottom surface and product label area;

g. adhesively attaching soft feet portions of non-slip material to the corners of the base surface to prevent the card holder from sliding.

* * * * *